US006835101B2

(12) United States Patent
Ishikawa et al.

(10) Patent No.: US 6,835,101 B2
(45) Date of Patent: Dec. 28, 2004

(54) MODULAR JACK AND MODULAR JACK CONNECTOR

(75) Inventors: Hiroshi Ishikawa, Tokyo (JP); Shinjiro Fujiwara, Tokyo (JP); Kenichi Hirokawa, Tokyo (JP)

(73) Assignees: Hitachi Cable, Ltd., Tokyo (JP); Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/442,197

(22) Filed: May 21, 2003

(65) Prior Publication Data

US 2003/0220023 A1 Nov. 27, 2003

(30) Foreign Application Priority Data

May 21, 2002 (JP) ..... 2002-146233

(51) Int. Cl.[7] ..... H01R 24/00
(52) U.S. Cl. ..... 439/676; 439/941
(58) Field of Search ..... 439/676, 76.1, 439/941, 395–405

(56) References Cited

U.S. PATENT DOCUMENTS 5,639,266 A * 6/1997 Patel ..... 439/676
5,647,770 A * 7/1997 Belopolsky ..... 439/676
6,120,330 A * 9/2000 Gwiazdowski ..... 439/676
6,533,618 B1 * 3/2003 Aekins ..... 439/676
6,579,127 B2 * 6/2003 Hess et al. ..... 439/676
6,629,862 B2 * 10/2003 Schmidt et al. ..... 439/676
6,749,466 B1 * 6/2004 Milner et al. ..... 439/676

* cited by examiner

*Primary Examiner*—Tho D. Ta
*Assistant Examiner*—Edwin A. Leon
(74) *Attorney, Agent, or Firm*—McGinn & Gibb, PLLC

(57) ABSTRACT

A modular jack and a modular jack connector which are suitable for use in twisted pair wiring system and suppress coupling in and out of a modular jack are provided. A modular jack, comprising, a hollow housing of which one end is opened, and eight conductor pins which are arranged with predetermined intervals to right and left directions inside said housing, each of said conductor pins has bending portion projecting toward said opening portion (this direction is defined by "forward"), lower part of said each conductor pin corresponds to a conductor pin leg which passes through bottom of said housing, when numbers from No. 1 to No. 8 are given respectively to said each conductor pin starting from right, each set of conductor pins of No. 1 and No. 2, No. 3 and No. 6, No. 4 and No. 5, and No. 7 and No. 8 is used respectively as conductor pair, bending portions of said No. 3 and No. 6 conductor pins are positioned more forward than bending portions of other conductor pins, and conductor pin legs of said No. 3 and No. 6 conductor pins are positioned more forward than conductor pin legs of other conductor pins.

4 Claims, 10 Drawing Sheets

MODULAR JACK AND MODULAR JACK CONNECTOR

The present application in based on Japanese Patent Application number 2002-146233, the entire contents of which are incorporated herein by reference.

BACKGROUND OF THE INVENTION

1. Field of the Invention

The present invention relates to a modular jack and a modular jack connector which are suitable for use in twisted pair wiring system, and more specifically to a modular jack and a modular jack connector which suppress coupling in and out of a modular jack.

2. Prior Art

In a wiring system for information communication such as LAN (Local Area Network) or telephone, a modular jack which is used for branch and extension of a wiring is defined in U.S.A. Wiring System Standard TIA/EIA568 or Japanese Industrial Standards JISx5150.

In an office of recent years, installation of LAN has been being carried out actively, and TP (twisted pair wire) which is comparatively easy for laying and changing has been being used in many wiring systems in office. A wiring system using this TP and combining data system and telephone system is shown in FIG. 1.

In this wiring system, plurality of IDFs (Intermediate Distribution Panel) 62 which are concentrically wired to MDF (Main Distribution Frame) 61 are installed, for example, on every floor of building, one or more consent box 63 or boxes 63 which is or are wired to IDF 62 is or are provided to various place of floor, if necessary next step consent box 64 is connected to consent box 63, and terminal 65 is connected to each consent box 63, 64.

A modular connector type patch panel which concentrically wires TP is shown in FIG. 2, and consent box is shown in FIG. 3. As shown in these figures, plurality of modular connectors or modular jack connectors 71, 81 are arranged side-by-side to patch panel or consent box.

Modular jack is shown in FIG. 4. Modular jack 91 comprises housing 93 provided with opening 92 to which modular cable (not shown in the figure) is inserted, and eight conductor pins 94 which are incorporated within housing. Provided, this modular jack shown in the figure is according to an embodiment of the present invention, conventional modular jack is different from the figure in arrangement of conductor pins.

Modular jack connector is shown in FIG. 5. Modular jack connector 101 is constituted by mounting modular jack 91 on substrate 102 and mounting crimping terminal array 103 which is so-called 110 type on substrate 102. This modular jack connector 101 is according to an embodiment of the present invention, modular jack connector which combined modular jack and crimping terminal array has not been realized heretofore.

As shown in FIG. 6, crimping terminal 111 comprises blade portion 112 to which TP is inserted and lead portion 113 which is soldered to substrate 102.

Inner structure of conventional modular jack is shown in FIG. 7(*a*) and FIG. 7(*b*). As shown in FIG. 7(*a*), this modular jack 121 is provided with approximately cubic shaped hollow housing 122 of which left side end in the figure is opened, and inside of the housing 122, eight conductor pins 125 having convex bending portion 124 toward opening portion 123 (referred to as "forward") are arranged at even intervals to right and left direction. Lower part of each conductor pin 125 corresponds to conductor pin leg 126 which passes through bottom of housing 122, and as shown in FIG. 7(*b*) numbers one to eight (1–8) are given to each conductor pin 125 in a manner of arranged order from right end as viewed opening portion 123 from outside. Each set of No. 1 and No. 2 conductor pins 125, No. 3 and No. 6 conductor pins 125, No. 4 and No. 5 conductor pins 125, and No. 7 and No. 8 conductor pins 125 is used as conductor pair. Conductor pair means a set of conductors connected to same twisted pair wires.

As shown in the figures, in conventional modular jack, all bending portions 124 of eight conductor pins 125 are lined up at same position toward forward, and eight conductor pin legs 126 are arranged in two lines, wherein No. 1, 3, 5, and 7 conductor pin legs 126 are in a forward line, and No. 2, 4, 6 and 8 conductor pin legs 126 are in a backward line.

In conventional U.S.A. Wiring System Standard, only category Se which defines near end cross talk attenuation between twist pairs to be more than 43 dB at 100 MHz is provided. However, category 6 which defines up to frequency band of 250 MHz is engaged to be enacted in U.S.A. Wiring System Standard in 2002. In category 6, connector is required to have near end cross talk attenuation of more than 54 dB which exceeds category 5*e* 11 dB at 100 MHz and more than 46 dB at 250 MHz, it becomes necessary to cancel coupling (electromagnetic coupling) within modular jack and coupling caused by components (substrate, crimping terminal and etc.) other than modular jack. Coupling within modular jack is notably caused by arrangement of No. 3 and No. 6 conductor pins which are sandwiching No. 4 and No. 5 conductor pins, and moreover No. 3 and No. 6 conductor pair space being larger than other conductor pair space, this coupling originates deterioration of cross talk characteristics. Accordingly, improvement to reduce this coupling is desired.

As explained above, in order to fit for category 6 which defines near end cross talk attenuation to be more than 54 dB at 100 MHz and more than 46 dB at 250 MHz, it is necessary to suppress coupling in and out of modular jack. Also, the applicant is going to provide a component (modular jack connector) which combined and unified modular jack with twisted pair wire fitting terminal, it is necessary co suppress coupling in whole modular jack connector.

SUMMARY OF THE INVENTION

An object of the present invention is to provide a modular jack and a modular jack connector which suppresses coupling in and out of a modular jack.

In accordance with this invention, there is provided a modular jack, comprising, a hollow housing of which one end is opened, and eight conductor pins which are arranged with predetermined intervals to right and left directions inside said housing, wherein, each of said conductor pins has bending portion projecting toward said opening portion (this direction is defined by "forward"), lower part of said each conductor pin corresponds to a conductor pin leg which passes through bottom of said housing, when numbers from No. 1 to No. 8 are given respectively to said each conductor pin starting from right, each set of conductor pins of No. 1 and No. 2, No. 3 and No. 6, No. 4 and No. 5, and No. 7 and No. 8 is used respectively as conductor pair, bending portions of said No. 3 and No. 6 conductor pins are positioned more forward than bending portions of other conductor pins, and conductor pin legs of said No. 3 and No. 6 conductor pins are positioned more forward than conductor pin legs of other conductor pins.

In accordance with this invention, there is provided a modular jack, wherein, eight conductor pin legs are arranged in three lines comprising line of No. 3 and No. 6 conductor pin legs, line of No. 2, No. 5 and No. 7 conductor pin legs, and line of No. 1, No. 4 and No. 8 conductor pin legs starting from forward.

In accordance with this invention, there is provided a modular jack, wherein, No. 1 and No. 8 conductor pin legs are arranged symmetrically and No. 2 and No. 7 conductor pin legs are arranged symmetrically.

In accordance with this invention, there is provided a modular jack, wherein, lining up direction of No. 1 and No. 2 conductor pin legs and lining up direction of No. 7 and No. 8 conductor pin legs are showing "ハ" shape by narrowing in forward and widening in backward.

In accordance with this invention, there is provided a modular jack connector, comprising, a modular jack mounted on a substrate using conductor pin legs, and crimping terminal array mounted on said substrate and provided with eight crimping terminals which are electrically connected to each conductor pin leg, wherein, said modular jack comprising, a hollow housing of which one end is opened, and eight conductor pins which are arranged with predetermined intervals to right and left directions inside said housing, each of said conductor pins has bending portion projecting toward said opening portion (this direction is defined by "forward"), lower part of said each conductor pin corresponds to a conductor pin leg which passes through bottom of said housing, when numbers from No. 1 to No. 8 are given respectively to said each conductor pin starting from right, each set of conductor pins of No. 1 and No. 2, No. 3 and No. 6, No. 4 and No. 5, and No. 7 and No. 8 is used respectively as conductor pair, bending portions of said No. 3 and No. 6 conductor pins are positioned more forward than bending portions of other conductor pins, and conductor pin legs of said No. 3 and No. 6 conductor pins are positioned more forward than conductor pin legs of other conductor pins.

In accordance with this invention, there is provided a modular jack connector, wherein, said substrate is provided with eight holes to which said conductor pin legs are passed through, and holes to which No. 3 and No. 6 conductor pin legs are passed through are positioned more forward than holes co which other conductor pin legs are passed through.

In accordance with this invention, there is provided a modular jack connector, wherein, said substrate is double-sided printed wiring board.

In accordance with this invention, there is provided a modular jack connector, wherein, symmetrical path is included in wiring pattern which extends from hole to which conductor pin leg is passed through to hole to which lead of said crimping terminal array is passed through.

In accordance with this invention, there is provided a modular jack connector, wherein, paths which are parallel each other are included in No. 3 and No. 6 wiring patterns which are electrically connected to No. 3 and No. 6 conductor pins, and paths which are included in No. 4 and No. 5 wiring patterns which is electrically connected to No. 4 and No. 5 conductor pins are provided between said parallel paths.

In accordance with this invention, there is provided a modular jack connector, wherein, arrangement of said eight crimping terminals of crimping terminal array is divided into 2 lines of right and left, and arrangement of right side line is No. 1, No. 2, No. 4 and No. 5 (these Nos. correspond to Nos. of conductor pins) starting from forward, and arrangement of left side line is No. 8, No. 7, No. 6 and No. 3 (these Nos. correspond to Nos. of conductor pins) starting from forward.

BRIEF DESCRIPTION OF THE DRAWINGS

The invention will be explained in more detail in conjunction with the appended drawings, wherein:

FIG. 7(*b*) is a bottom view showing a conventional modular jack.

FIG. 8(*b*) is a bottom view showing a modular jack according to an embodiment of the present invention.

DESCRIPTION OF THE PREFERRED EMBODIMENTS

Preferred embodiments of the present invention will be explained in conjunction with accompanying drawings.

Figure 8A:
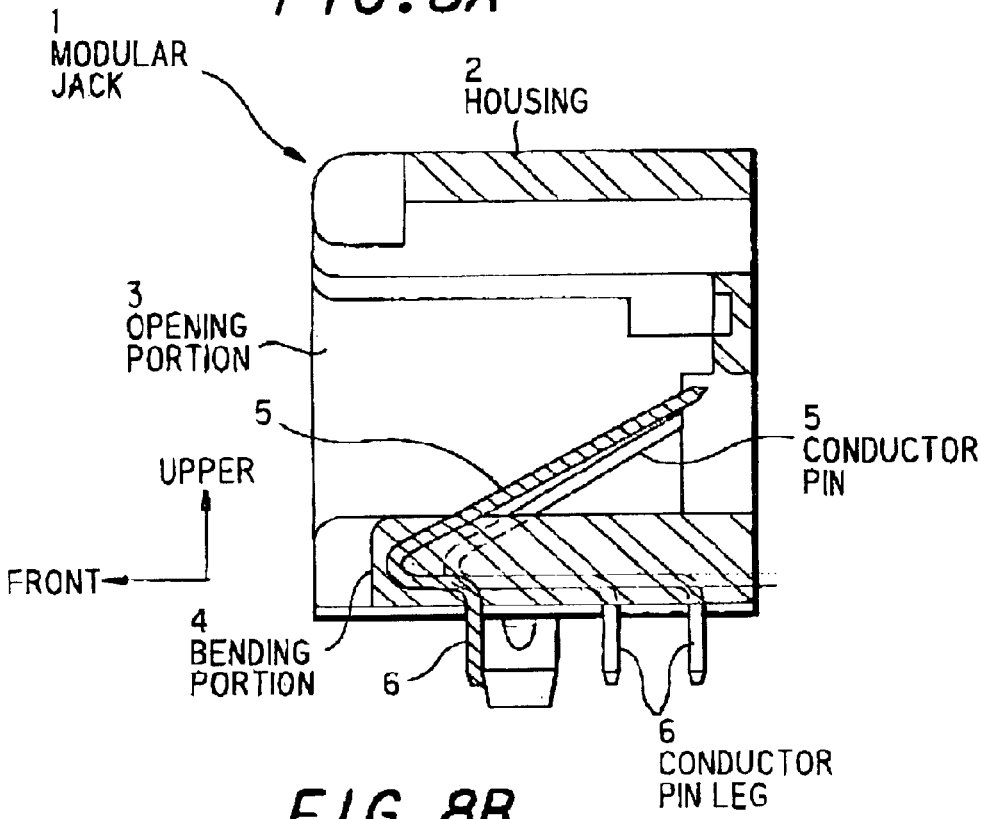
FIG. 8(*a*) is a right side view showing a modular jack according to an embodiment of the present invention.
Figure 8B:
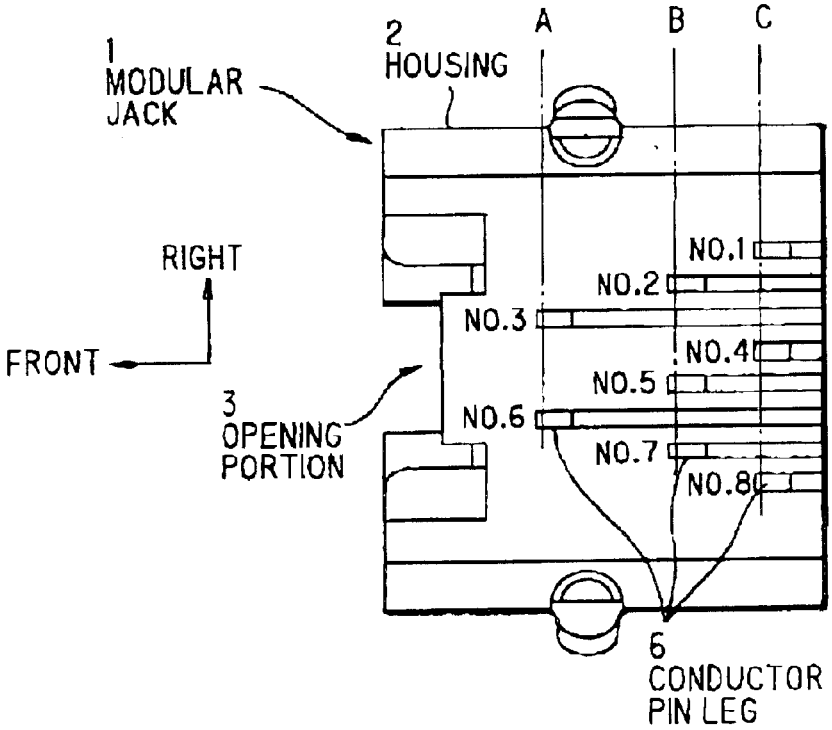

As shown in FIG. 8(*a*), modular jack 1 in accordance with one embodiment of the present invention is provided with approximately cubic shaped hollow housing 2 of which one end of left side in the figure is opened, and inside of the housing 2, eight conductor pins 5 having convex bending portion (or called as fulcrum) 4 toward opening portion 3 (referred to as "forward") are arranged with even intervals to right and left directions as viewed from front. Lower part of each conductor pin 5 corresponds to conductor pin leg 6 which passes through bottom of housing 2, and as shown in FIG. 8(*b*), numbers from one to eight (1–8) are given to each conductor pin 5 in a manner of arranged order from right end as viewed opening portion 3 from outside. Each set of No. 1 and No. 2 conductor pins 5, No. 3 and No. 6 conductor pins 5. No. 4 and No. 5 conductor pins 5, and No. 7 and No. 8 conductor pins 5 is used as conductor pair. Conductor pair means a set of conductors connected to same twisted pair wire.

Modular jack 1 in accordance with the present invention is compatible with conventional article pursuant to TIA/EIA568B or JISX5150, but conductor pin structure and conductor pin leg arrangement are provided with unprecedented constitution.

Figure 9:
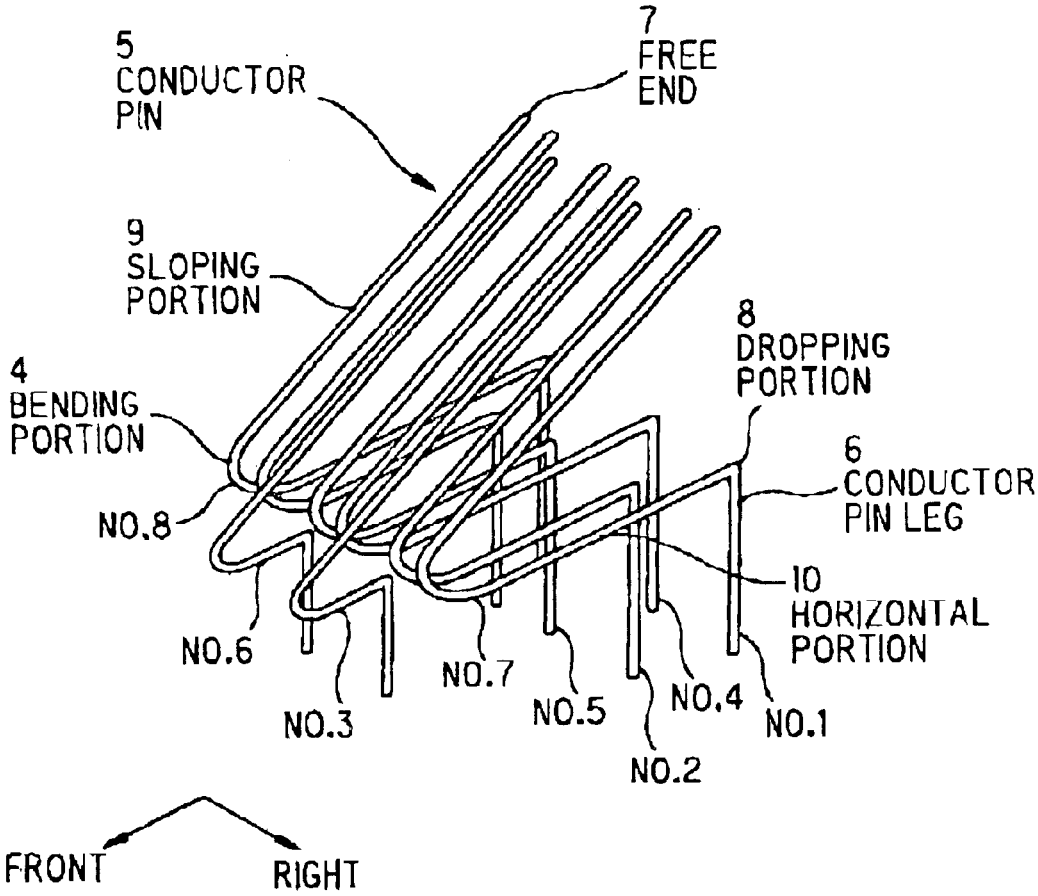
FIG. 9 is a perspective view showing conductor pins according to an embodiment of the present invention.

Structure of conductor pins 5 is shown in FIG. 9. Each of conductor pins 5 extends toward forward and diagonal downward from upper portion (referred to as "free end") 7 of interior of housing 2, extends horizontally by turning at bending portion 4, and conductor pin leg 6 is formed by turning to downward at right angle. Turning potion to downward is called dropping portion 8. Back and forth position of bending portion 4 of each conductor pin 5 is different according to number of conductor pins 5. Because upper and lower position and front and back position of free end 7 and upper and lower position of bending portion 4 are approximately same without depending upon number of conductor pins 5, but back and forth position of bending portion 4 of each conductor pin 5 is different according to number of conductor pins 5, sloping portion 9 which extends from free end 7 to bending portion 4 differs angle of gradient according to number of conductor pins 5. Namely, in FIG. 8(*a*), conductor pins 5 (No. 3 and No. 6) to which hatching is written and other conductor pine 5 to which hatching is not written are different in position of bending portion 4 and angle of gradient, sloping portions 9 of the former and the latter are not parallel each other. Further, position of horizontal portions 10 which extends from bending portion 4 to dropping portion a are different according to number of conductor pins 5, too. Namely, in FIG. 8(*a*), conductor pins 5 (No. 3 and No. 6) to which hatching is written are dropped from vicinity of bending portion 4 of other conductor pins 5 to which hatching is not written, horizontal portions 10 of conductor pins 5 (No. 3 and No. 6) to which hatching is written does not almost adjacent to horizontal portions 10 of other conductor pins 5 to which hatching is not written.

In the present invention, bending portions 4 of No. 3 and No. 6 conductor pins 5 are positioned more forward than bending portions of other conductor pins 5. This is carried out for the purpose of reducing electrostatic coupling and electromagnetic coupling between No. 3 and No. 6 conductor pins 5 and other conductor pine 5. In addition, conductor pin legs of No. 3 and No. 6 conductor pins (No. 3 and No. 6 conductor pin legs 6) may be dropped from just below bending portion 4. Furthermore, in the present invention, No. 3 and No. 6 conductor pin legs 6 are positioned more forward than other conductor pin legs 6. This is also carried out for the purpose of reducing electrostatic coupling and electromagnetic coupling between No. 3 and No. 6 conductor pins 5 and other conductor pins 5. In consequence, eight conductor pin legs 6 are arranged in three lines wherein in order starting from front, line A of No. 3 and No. 6, line B of No. 2, No. 5 and No. 7 and line C of No. 1. No. 4 and No. 8 (refer to FIG. 8(*b*)).

Further, No. 1 and No. 8 conductor pin legs 6 are arranged symmetrically with center of housing 2 as axis of symmetry, and also No. 2 and No. 7 conductor pin legs 6 are arranged symmetrically with center of housing 2 as axis of symmetry. Furthermore, lining up direction of No. 1 and No. 2 conductor pin legs 6 and lining up direction of No. 7 and No. 8 conductor pin legs 6 are showing "ハ" shape by narrowing in forward and widening in backward. These futures of arraying conductor pin legs are advantageous in obtaining electric characteristics of substrate wiring pattern as will be described later.

Figure 10:
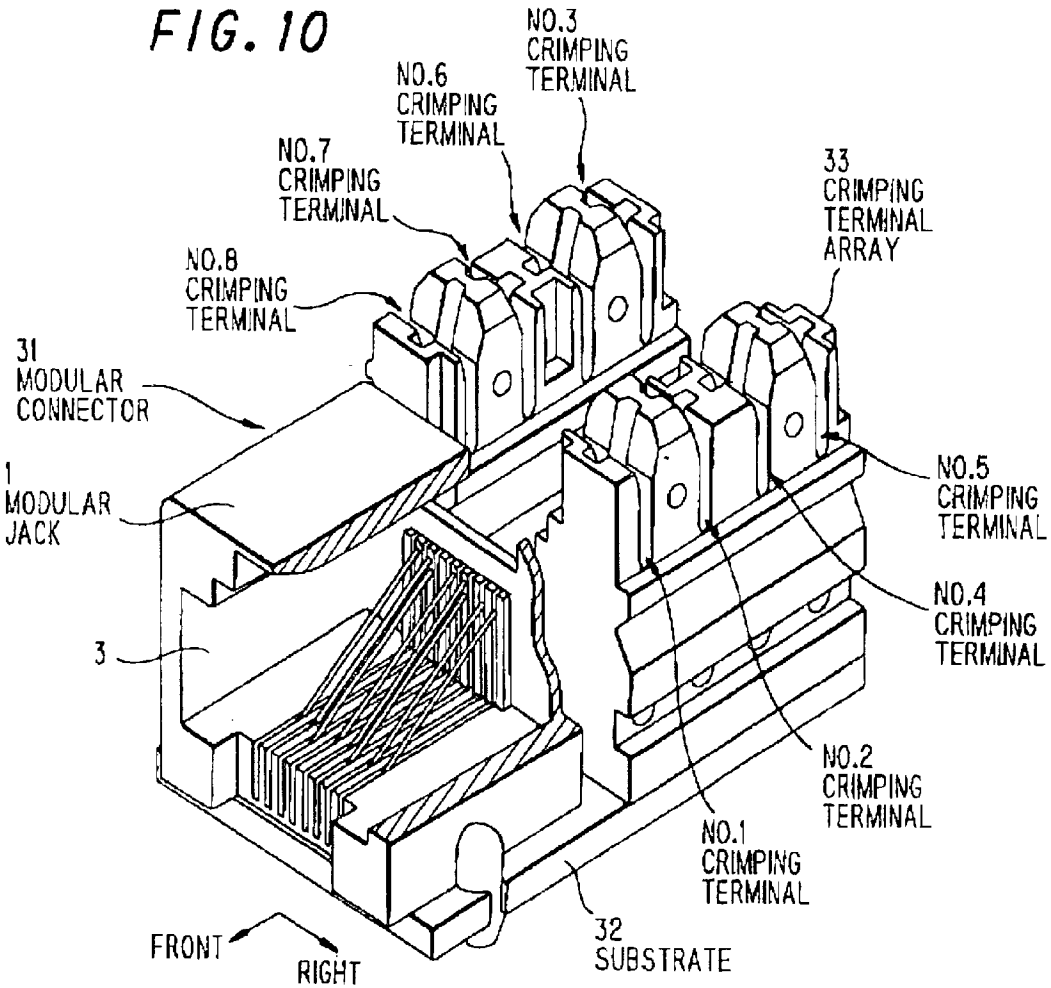
FIG. 10 is a perspective view showing a modular jack connector according to an embodiment of the present invention.

As shown in FIG. 10, modular jack connector 31 in accordance with an embodiment of the present invention comprises mounting modular jack 1 shown in FIG. 8(*a*) and FIG. 8(*b*) on substrate 32 using conductor pin legs 6, and mounting crimping terminal array 33 provided with eight crimping terminals which are electrically connected to each conductor pin leg 6 on substrate 32.

Figure 11:
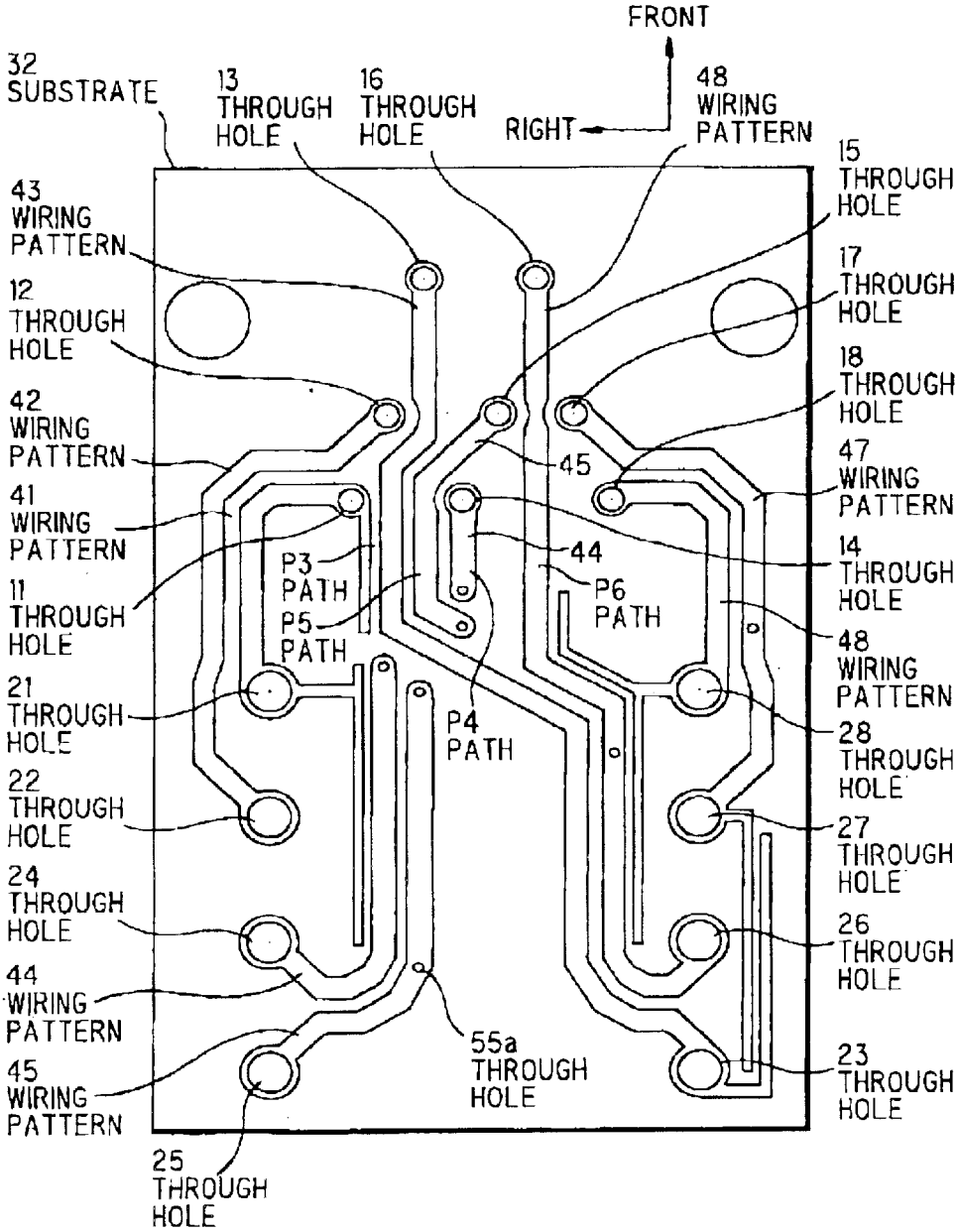
FIG. 11 is a explanatory view showing component side of a substrate according to an embodiment of the present invention.
Figure 12:
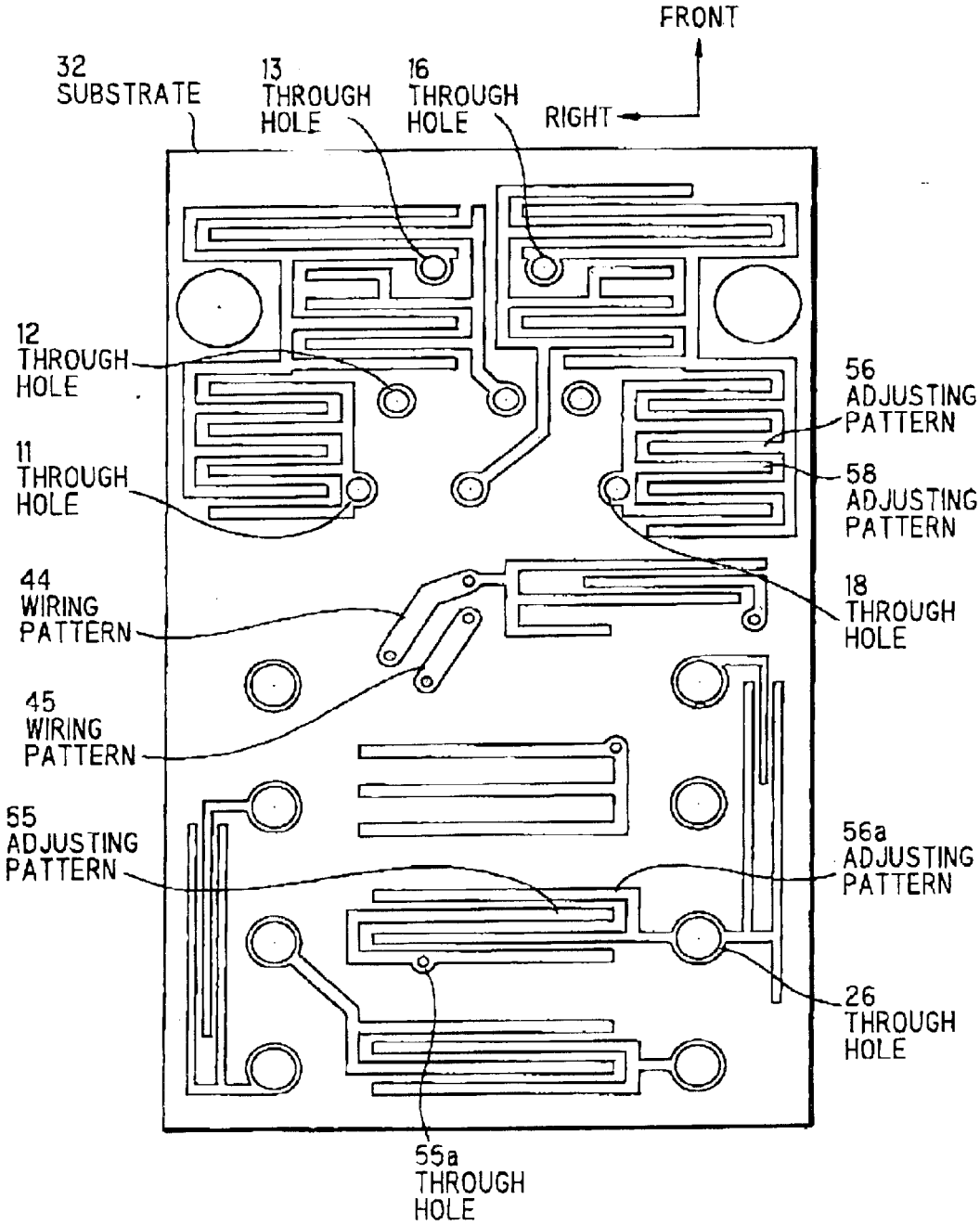
FIG. 12 is a explanatory view showing solder side of a substrate according to an embodiment of the present invention.

As shown in FIG. 11 and FIG 12, substrate 32 is double-sided printed wiring board. FIG. 11 shows component side, upper ward of the figure is an opening portion direction (forward) of modular jack 1, and left direction in the figure is right direction as viewed opening portion 123 from outside. FIG. 12 shows solder side, the figure is shown by perspective from component side (not viewed from reverse side). Therefore, as well as FIG. 11, upper ward of the figure is forward of modular jack 1, and left direction in the figure is right direction of modular jack 1.

Substrate 32 is provided with eight holes (through holes) 11–18 (last single digit corresponds to Nos. of conductor pins 5) to which conductor pin legs 6 are passed through. Among these holes, No. 3 and No. 6 holes 13, 16 are positioned forward of other holes such as No. 11, No. 12 and etc. In order to possible to mount modular jack 1 on substrate 32, arrangement of these holes is consistent with arrangement of conductor pin legs 6.

Further, substrate 32 is provided with eight holes (through holes) 21–28 (last single digit corresponds to Nos. of conductor pins 5) to which leads of crimping terminal array are passed through. Arrangement of these holes is consistent with arrangement of eight crimping terminals of crimping terminal array, holes are arranged by dividing into 2 lines of right and left, and spacing between holes of each line is equal. In right side line (note: drawn left side in FIGS. 11 and 12) of substrate 32, No. 1, No. 2, No. 4 and No. 5 holes 21, 22, 24, 25 are arranged starting from forward, and in left side line, No. 8, No. 7, No. 6 and No. 3 holes 28, 27, 26, 23 are arranged starting from forward.

Substrate 32 is provided with wiring patterns 41–48 (last single digit corresponds to Nos. of conductor pins 5) which electrically connects between each hole 11–18 to which conductor pin leg is passed through and each hole 21–28 to which lead of crimping terminal array is passed through respectively. Wiring patterns 41–48 are extending forward and backward in component side to connect between holes for conductor pins and holes for leads, and extending left and right direction in solder side to adjust impedance between each of wiring patterns.

Attending to component side (FIG. 11), symmetrical path with center of right and left of substrate 32 as axis of symmetry is included in wiring pattern. Here, path is a straight portion which forms a part of wiring pattern. For example, path of No. 3 wiring pattern 43 and path of No. 6 wiring pattern 46 are symmetrical in forward half of substrate 32. Further, path of No. 7 wiring pattern 47 and path of No. 2 wiring pattern 42 are symmetrical in center half of substrate 32.

Furthermore, attending to center and somewhat upper ward of component side, paths P3, P6 which are parallel each other are included in No. 3 and No. 6 wiring patterns 43, 46. And paths P4 and P6 which are included in No. 4 and No. 5 wiring patterns 44, 45 are provided between parallel paths P3, P6. Moreover, in this attending region, paths P3, P5, P4 and P6 are lined up starting from right (left in the figure). Line up in the order of No. 3, No. 4, No. 5 and No. 6 according to arrangement of conductor pins 5 (or conductor pin legs 6) become line up in the order of No. 3, No. 5, No. 4 and No. 6 in this region. Namely, wiring pattern 44 which forms path P4 is extended straightly from No. 4 hole 14 to backward (downward in the figure) of substrate, on the contrary, wiring pattern 45 from No. 5 hole 15 which is positioned to left (right in the figure) of No. 4 hole 14 is not extending straightly to backward of substrate but is extended diagonally to go around No. 4 hole 14 to right (left in the figure). This caused reverse of line up order No. 4 and No. 5. This provided for electrical coupling between No. 3 wiring pattern and No. 5 wiring pattern by closing No. 3 path P3 and No. 5 path P5. Similarly, thin also provided for electrical coupling between No. 4 wiring pattern and No. 6 wiring pattern by closing No. 4 path P4 and No. 6 path P6.

Figure 1:
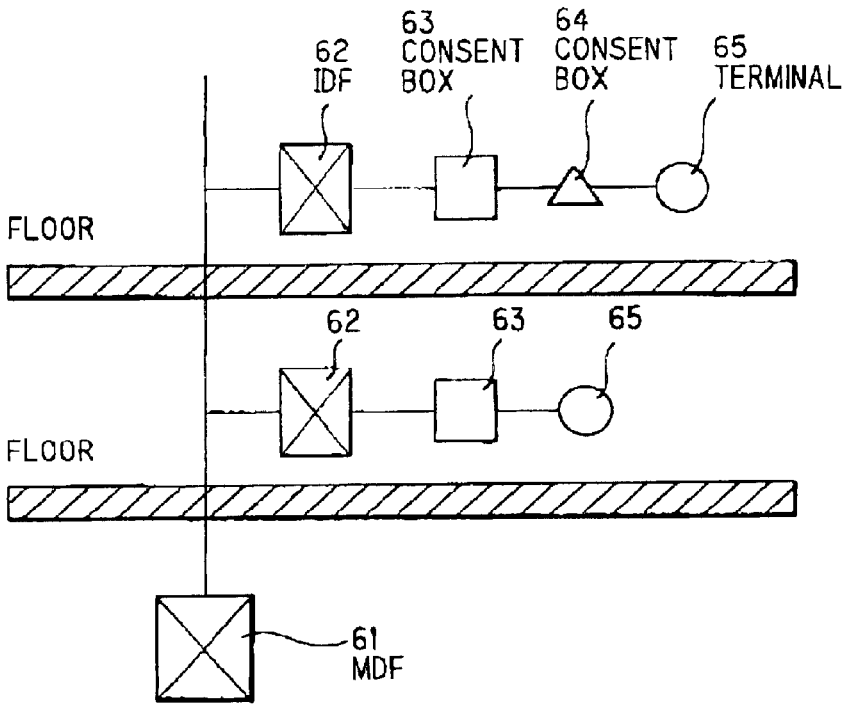
FIG. 1 PRIOR ART
FIG. 1 is a circuit diagram showing a wiring system in information communication.
Figure 2:
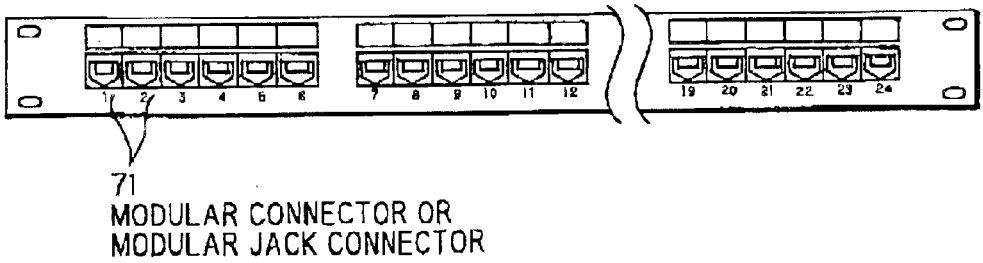
FIG. 2 PRIOR ART
FIG. 2 is a front view showing a conventional patch panel.
Figure 3:
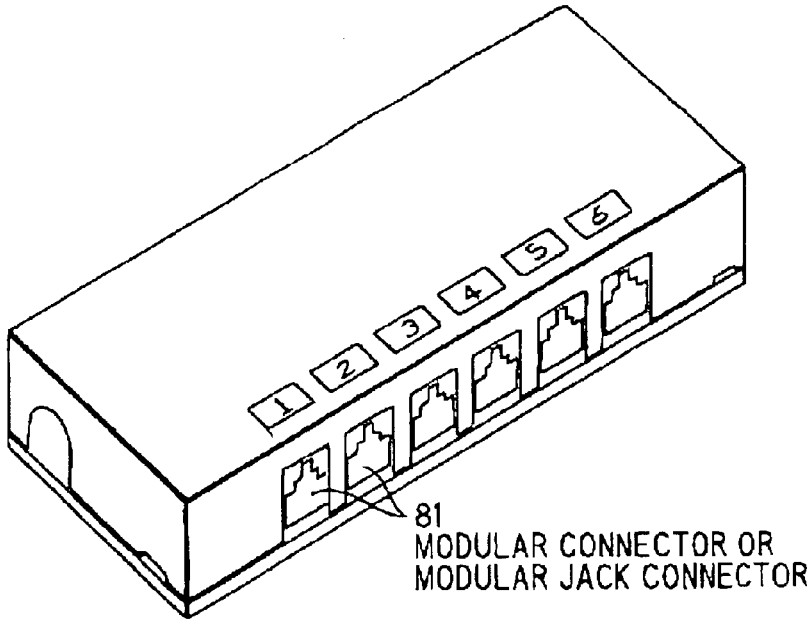
FIG. 3 PRIOR ART
FIG. 3 is a perspective view showing a conventional consent box.
Figure 4:
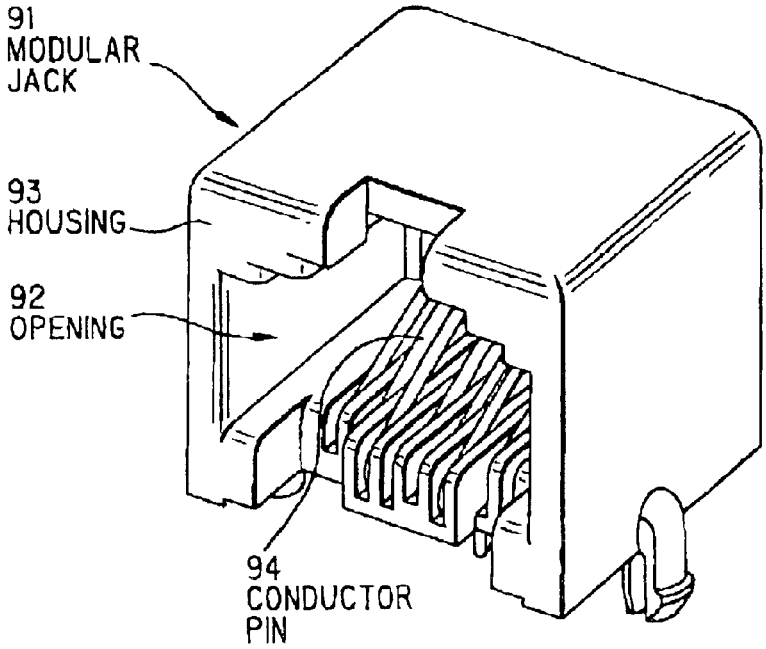
FIG. 4 is a perspective view showing a modular jack according to an embodiment of the present invention.
Figure 5:
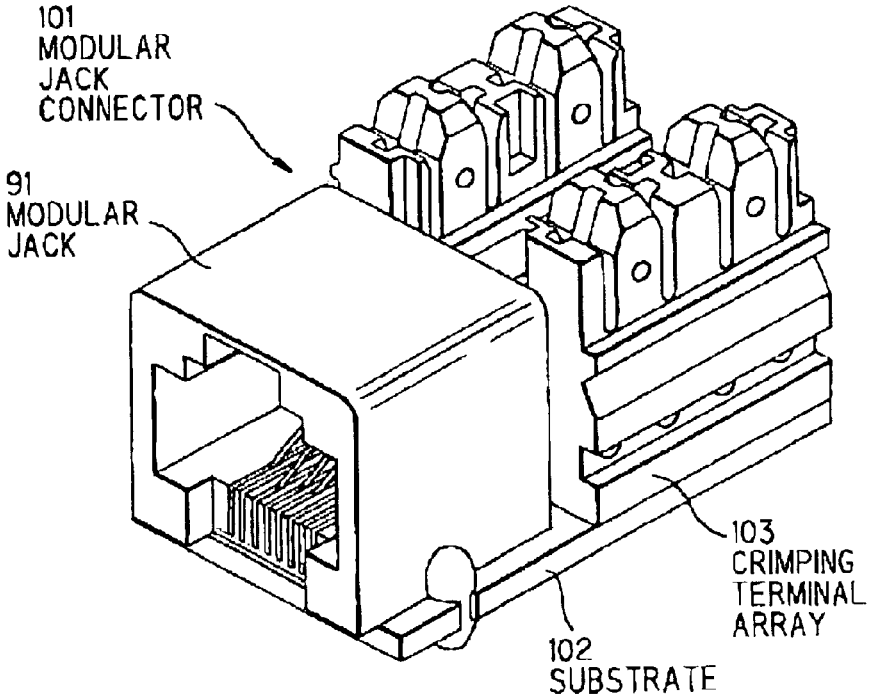
FIG. 5 is a perspective view showing a modular jack connector according to an embodiment of the present invention.
Figure 6:
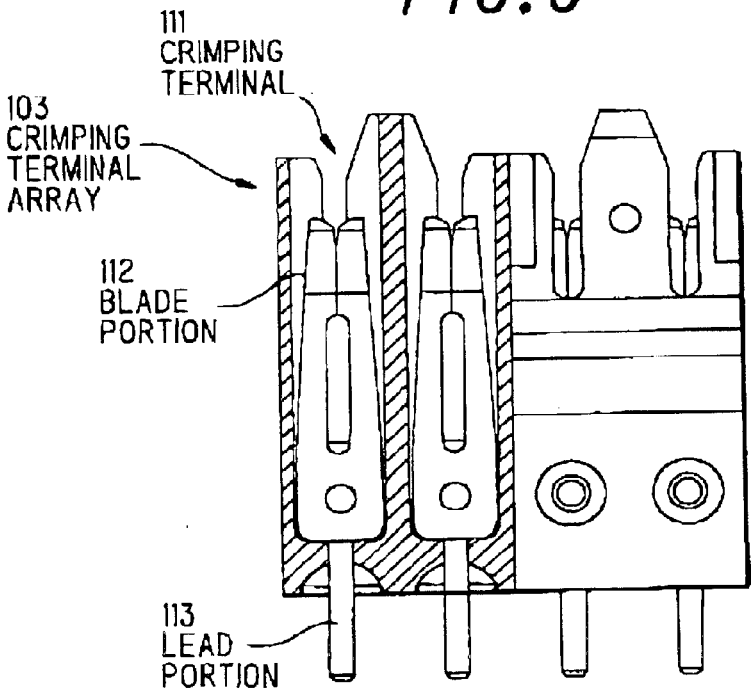
FIG. 6 is a partial cross sectional view showing a crimping terminal.
Figure 7A:
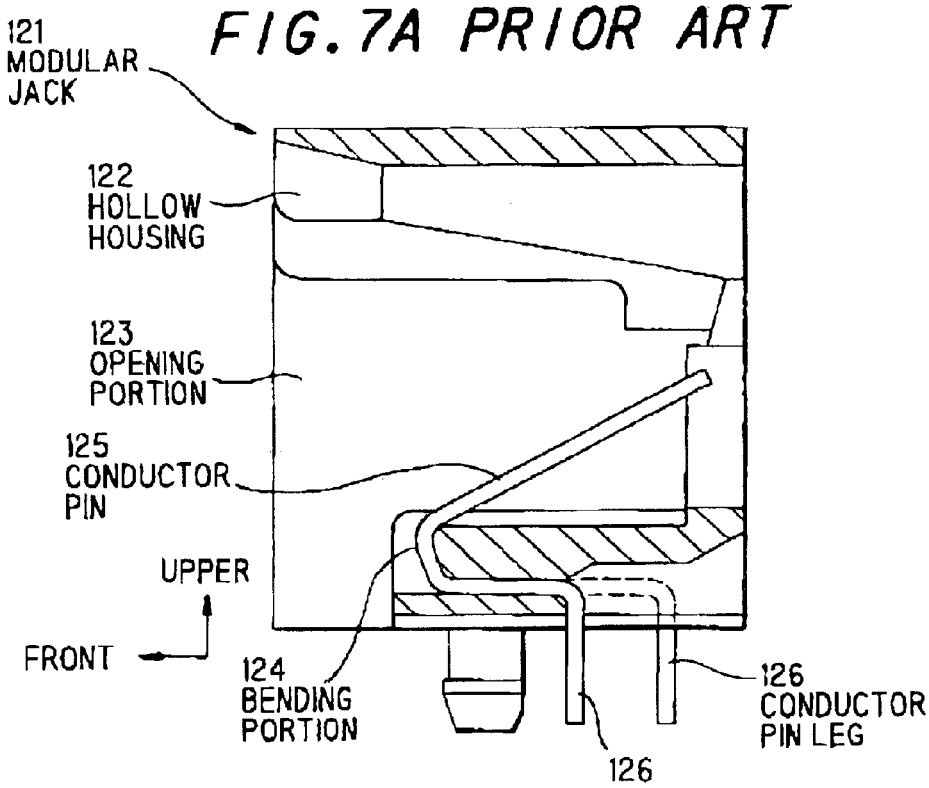
FIG. 7A PRIOR ART
FIG. 7(*a*) is a right side view showing a conventional modular jack.
Figure 7B:
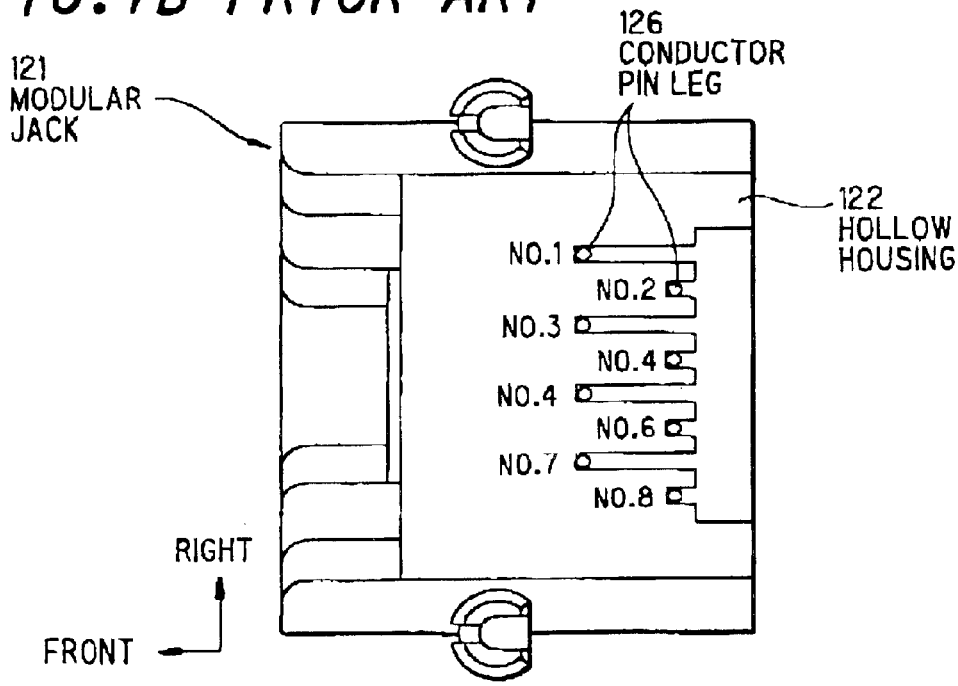
FIG. 7B PRIOR ART

According to constitution explained above, modular jack connector 31 in the present invention can suppress coupling in and out of modular jack. The reason will be explained in detail by comparing the present invention (FIGS. 8(*a*), 8(*b*) and 9) and conventional art (FIGS. 7(*a*) and 7(*a*)).

In conventional art, for example, with respect to relation between No. 2 conductor pin 125 and No. 3 conductor pin 125, because bending portions 124 are lined up at same in forward position, sloping portions are parallel each other and length of section in which horizontal parts are neighboring is long, spacing between each of conductor pins 125 is narrow, and narrowing portion is long (hereinafter collectively referred to as proximity). Accordingly, electrostatic coupling and electromagnetic coupling were large, and near end crosstalk attenuation between No. 1 and No. 2 conductor pair and No. 3 and No. 6 conductor pair was small (large in crosstalk) Similarly, due to proximity of No. 7 conductor pin 125 and No. 6 conductor pin 125, near end crosstalk attenuation between No. 7 and No. 8 conductor pair and No. 3 and No. 6 conductor pair was small, too. Further, between No. 4 and No. 5 conductor pair and No. 3 and No. 6 conductor pairs due to proximity of No. 5 conductor pin 125 and No. 6 conductor pin 125 in addition to proximity of No. 4 conductor pin 125 and No. 3 conductor pin 125, near end crosstalk attenuation was still more small.

Contrary in the present, No. 3, No. 6 conductor pin shape which was main cause of above problem was improved. Namely, bending portions 4 of No. 3 and No. 6 conductor pins 5 are positioned more forward than bending portions 4 of other conductor pins 5, and No. 3 and No. 6 conductor pin legs 6 are positioned more forward than other conductor pin legs 6. By this, spatial distance between conductor pins become larger than conventional art, and mutual capacitance is reduced by relaxation of above proximity. Therefore, near end crosstalk attenuation increases.

Further in the present invention, coupling which cannot be resolved by improvement of conductor pin shape is resolved by electrical characteristic of substrate wiring pattern. Namely, coupling between No. 3 wiring pattern and No. 5 wiring pattern and coupling between No. 4 wiring pattern and No. 6 wiring pattern are provided for by lineup of paths P3, P5, P4 and P6. By this, coupling between No. 3 conductor pin and No. 4 conductor pin and coupling between No. 5 conductor pin and No. 6 conductor pin are cancelled.

Line up length of paths P3, P5, P4 and P6 is preferably determined in accordance with conductor pin coupling, in the present invention, since No. 3, No. 6, No. 4 and No. 5 crimping terminals are arrayed most backward of substrate 32 in crimping terminal arrangement of crimping terminal array 33, there is advantage that line up length of paths P3, P5, P4 and P6 can be determined freely.

In this embodiment, in order to resolve coupling which cannot be resolved by conductor pin shape and path arrangement, impedance control pattern (referred to as "adjusting pattern") is provided to substrate 32. Namely, on solder side (FIG. 12), holes to which conductor pin legs are passed through, holes to which leads are passed through and adjusting pattern which are extended from halfway of wiring pattern are formed. Pectinate branches of different numbered adjusting pattern are closing alternately. For example, adjusting pattern 58 from No. 8 hole 18 and adjusting pattern 56 from No. 6 hole 16 are combined. Further, adjusting pattern 56*a* from No. 6 hole 26 and adjusting pattern 55 from through hole 55*a* in wiring pattern 45 are combined. Crosstalk compensating technique according to adjusting pattern is disclosed in "Cable Transmitting Engineering" (By Yoshio Kasahara, Kyoritsu publishing, issued on 1968), and is publicly known. However, patentability exists in obtaining specific effect which facilitates fabrication of adjusting pattern by combining with crosstalk compensating technique according to conductor pin shape and path arrangement.

Figure 13:
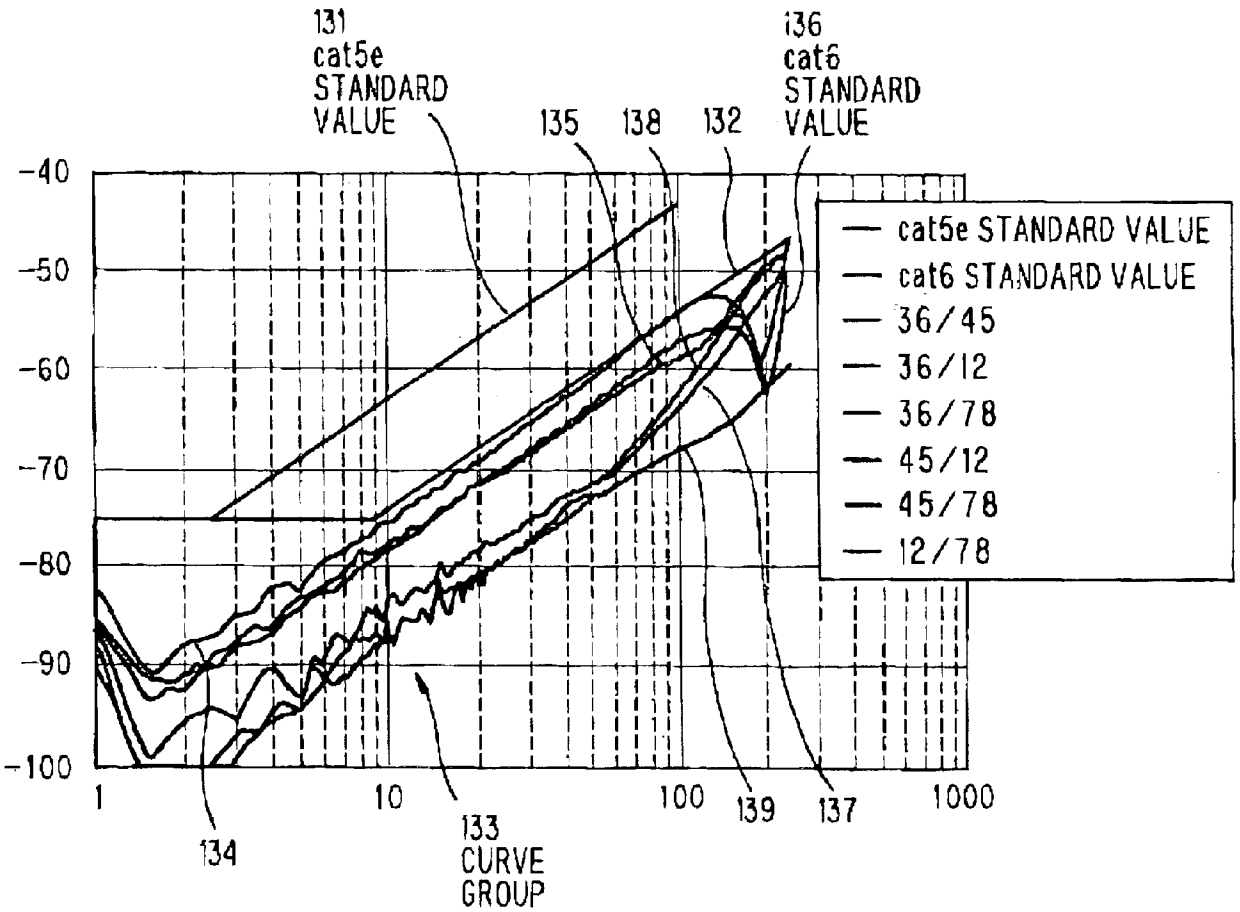
FIG. 13 is a graph showing near end cross talk attenuation characteristic.

FIG. 13 shows near end crosstalk attenuating characteristic between pairs measured for modular jack connector of the present invention. Horizontal axis is frequency and vertical axis is attenuation, attenuation is large toward downward of the figure. Cat 5*e* standard value 131 is characteristic required by category 5*e*, and cat 6 standard value 132 is characteristic required by category 6. 36/45 means characteristic between No. 3 and No. 6 conductor pair and No. 4 and No. 5 conductor pair, and similarly Nos. of conductor pair are entered both sides of/. Total six ways of near end crosstalk attenuation between four sets of each conductor pair are shown by curve group 133. Breakdown of curve group 133 is that 36/45 is curve 134, 36/12 is curve 135, 36/78 is curve 136, 45/12 is curve 137, 45/78 is curve 138 and 12/78 is curve 139. AS understood from the figure, modular jack connector of the present invention fully complies with requirement of category 6.

The present invention exhibits superior effects as follows.

(1) Since conductor pin shape is diversified, mutual capacitance is reduced, and crosstalk is suppressed.

(2) Since wiring pattern is provided with reverse polarity coupling with conductor pin, crosstalk is suppressed.

Although the invention has been described with respect to specific embodiment and clear disclosure, the appended claims are not to be thus limited but are to be construed as embodying all modification and alternative constructions that may be occurred to one skilled in the art which fairly fall within the basic teaching herein set forth.

What is claimed is:

1. A modular jack, comprising, a hollow housing of which one end is opened, and eight conductor pins which are arranged with predetermined intervals to right and left directions inside said housing, wherein:

each of said conductor pins has bending portion projecting toward said opening portion (this direction is defined by "forward"), lower part of said each conductor pin corresponds to a conductor pin leg which passes through bottom of said housing, when numbers from No. 1 to No. 8 are given respectively to said each conductor pin starting from right, each set of conductor pins of No. 1 and No. 2, No. 3 and No. 6, No. 4 and No. 5, and No. 7 and No. 8 is used respectively as conductor pair, bending portions of said No. 3 and No. 6 conductor pins are positioned more forward than bending portions of other conductor pins, and conductor pin legs of said No. 3 and No. 6 conductor pins are positioned more forward than conductor pin legs of other conductor pins.

2. A modular jack according to claim 1, wherein:

eight conductor pin legs are arranged in three lines comprising line of No. 3 and No. 6 conductor pin legs, line of No. 2, No. 5 and No. 7 conductor pin legs, and line of No. 1, No. 4 and No. 8 conductor pin legs starting from forward.

3. A modular jack according to claim 1, wherein:

No. 1 and No. 8 conductor pin legs are arranged symmetrically and No. 2 and No. 7 conductor pin legs are arranged symmetrically.

4. A modular jack according to claim 1, wherein:

lining up direction of No. 1 and No. 2 conductor pin legs and lining up direction of No. 7 and No. 8 conductor pin legs are showing "/\" shape by narrowing in forward and widening in backward.

* * * * *